US009080827B2

(12) United States Patent
Franceschi

(10) Patent No.: US 9,080,827 B2
(45) Date of Patent: Jul. 14, 2015

(54) ROBOTIZED ARM FOR A VEHICLE

(75) Inventor: Giuliano Franceschi, Le Spezia (IT)

(73) Assignee: OTO Melara S.p.A., La Spezia (IT)

( * ) Notice: Subject to any disclaimer, the term of this patent is extended or adjusted under 35 U.S.C. 154(b) by 0 days.

(21) Appl. No.: 13/115,757

(22) Filed: May 25, 2011

(65) Prior Publication Data

US 2012/0024142 A1 Feb. 2, 2012

(30) Foreign Application Priority Data

May 26, 2010 (IT) ..... TO2010A0440

(51) Int. Cl.
*F41A 23/24* (2006.01)
*F41A 23/20* (2006.01)

(52) U.S. Cl.
CPC ..... *F41A 23/20* (2013.01)

(58) Field of Classification Search
CPC ..... E02F 3/404; E02F 3/3609; E02F 3/4133; E02F 3/962; F41A 23/34; F41A 23/38; F41A 23/32; F41A 23/26; F41A 23/56; F41A 23/00; F41A 25/00; F41A 27/06
USPC ..... 89/37.17, 40.03, 41.19, 37.02, 40.04, 89/37.07; 900/2; 414/729; 700/251; 901/2
See application file for complete search history.

(56) References Cited

U.S. PATENT DOCUMENTS

| | | | | | |
|---|---|---|---|---|---|
| 4,785,760 | A * | 11/1988 | Tholome | 118/323 |
| 5,430,643 | A * | 7/1995 | Seraji | 700/263 |
| 5,581,166 | A * | 12/1996 | Eismann et al. | 318/568.22 |
| 5,867,631 | A * | 2/1999 | Sato et al. | 700/262 |
| 7,624,670 | B2 | 12/2009 | Richeux | |
| 2005/0011348 | A1 | 1/2005 | Bertrand et al. | |
| 2005/0143860 | A1 * | 6/2005 | Nakajima et al. | 700/245 |
| 2007/0119296 | A1 * | 5/2007 | Niv et al. | 89/37.02 |
| 2009/0044655 | A1 * | 2/2009 | DeLouis et al. | 74/490.05 |
| 2009/0071281 | A1 * | 3/2009 | Fisk et al. | 74/490.03 |
| 2010/0068024 | A1 * | 3/2010 | Agens | 414/729 |

FOREIGN PATENT DOCUMENTS

| | | |
|---|---|---|
| EP | 1 717 540 | 11/2006 |
| FR | 2 832 792 | 5/2003 |
| WO | WO 01/51259 | 7/2001 |
| WO | WO 0151259 | * 7/2001 |

* cited by examiner

*Primary Examiner* — Samir Abdosh
*Assistant Examiner* — John D Cooper
(74) *Attorney, Agent, or Firm* — Merchant & Gould P.C.

(57) ABSTRACT

A robotized arm is installable on a vehicle by a supporting plate, on which the arm is mounted. The vehicle includes a conventional passenger compartment, adapted to house operators. At the free end of the arm is supported an armament and the robotized arm enables the armament to have at least four degrees of freedom in space.

10 Claims, 2 Drawing Sheets

ROBOTIZED ARM FOR A VEHICLE

This application claims benefit of Serial No. TO 2010 A 000440, filed 26 May 2010 in Italy and which application is incorporated herein by reference. To the extent appropriate, a claim of priority is made to the above disclosed application.

BACKGROUND OF THE INVENTION

The present invention refers to a robotized arm installable on a vehicle.

In particular, the present invention describes a robotized arm installable on a military vehicle provided with an armament positioned on the turret or on the ammunition chest or on the open luggage compartment or caisson of the vehicle.

To the prior art are known armored vehicles movable through a system of tracks or wheeled vehicles provided with a central turret, preferably rotatable upon which is mounted the main armament which is usually constituted by a cannon.

The turret is also usually provided with one or more machine guns or armaments in general and with various laying and viewing means or systems, such as for example a day/night stabilized periscopic viewer for the commanding officer, a stabilized viewer with a thermal view and laser telemeter for the gunner, and a fire monitoring computer. The fire monitoring computer receives data from various sensors of the vehicle and is adapted to process all the data for determining the best fire conditions.

It is clear that these armaments are manually maneuvered by an operator also with the aid of servo-systems which facilitate the handling and laying operations of the armament itself.

The positions of the operator are always protected by shields, walls, or protecting bars, but clearly a risk percentage for the operator is present.

SUMMARY OF THE INVENTION

The present invention solves this problem providing a robotized arm, upon which it is supported an armament which is adapted to permit the handling and the activation of the armament itself, this arm being installable on a vehicle, for example on the top of the vehicle or on the ammunition chest.

BRIEF DESCRIPTION OF THE DRAWINGS

The characteristics and advantages of the arm according to the present invention will be clearer and evident from the following description, exemplificative and not limiting, of an embodiment with reference to the attached figures wherein.

DETAILED DESCRIPTION

Figure 1:
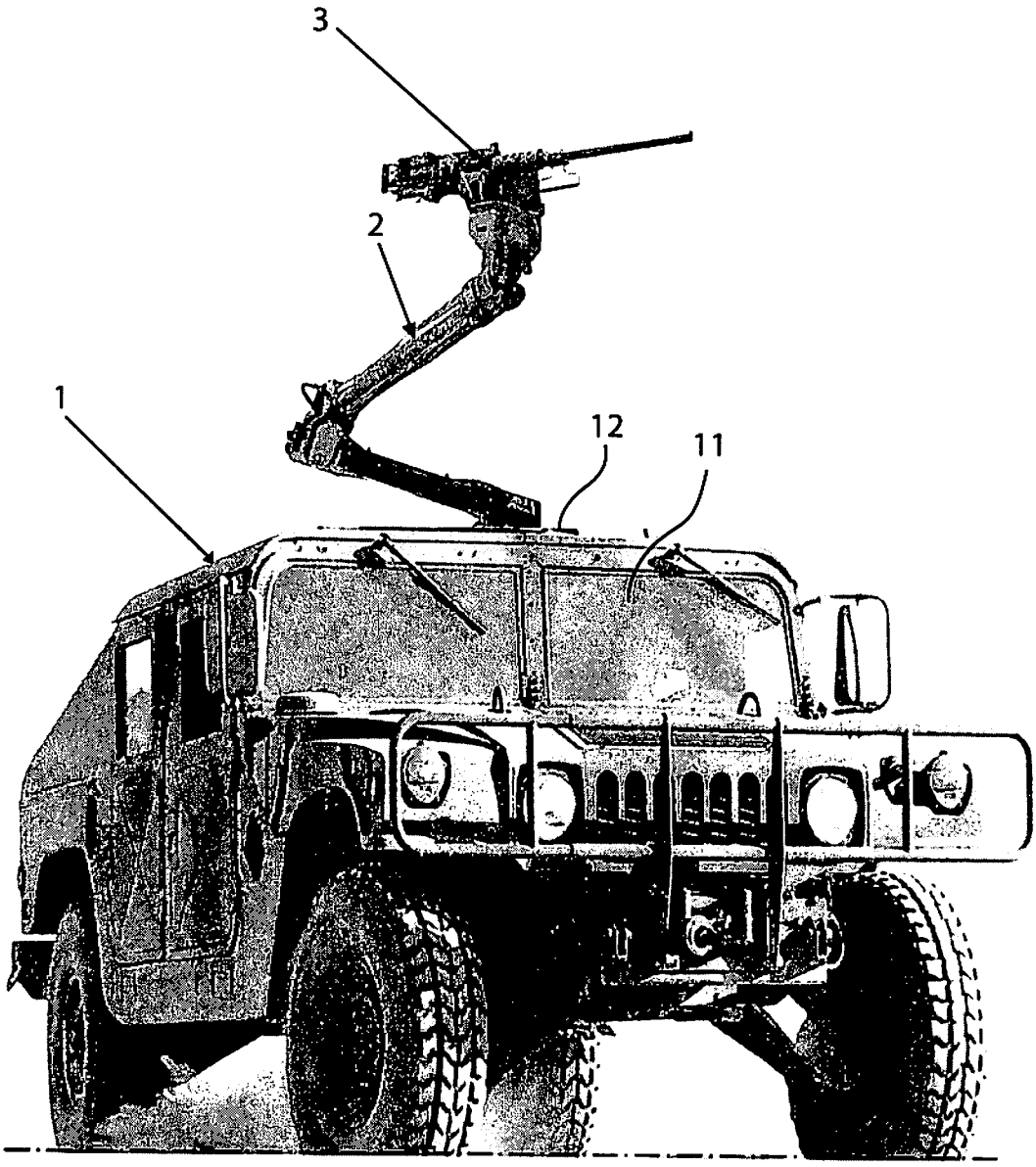
FIG. 1 is a view of the vehicle provided with robotized arm according to the present invention.
Figure 3:
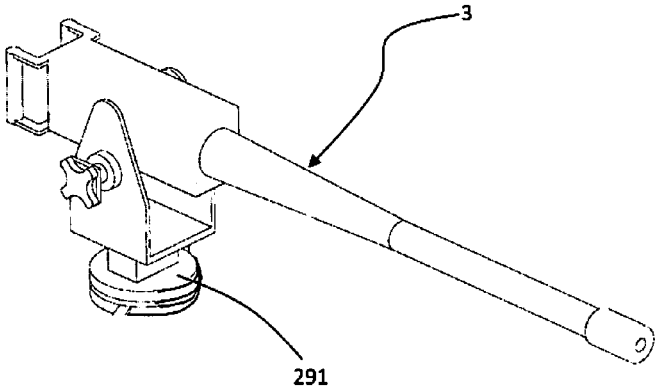
FIG. 3 is a view of a type of armament which can be supported by the arm of FIG. 2.

With reference to the above mentioned figures, vehicle 1 comprises a conventional passenger compartment 11, wherein there is the driver and the personnel responsible for the armaments. In the example of embodiment the vehicle illustrated is rotated wheeled vehicle, but the present invention can be equivalently applied to a tracked or hybrid vehicle.

On the top of the vehicle there is a supporting plate 12 upon which it is mounted a robotized arm 2 on which free end is supported an armament 3.

In an alternative embodiment the supporting plate can be positioned in positions different from the top of the passenger compartment, for example it can be fastened to the loading plane or ammunition chest or on the luggage compartment.

In general, the arm and the armament must be preferably positioned on a dominant position of the vehicle, for permitting the maximum shooting radius to the armament and the best handling of the arm.

This robotized arm is able to permit to this armament to have at least four degrees of freedom in space.

Four degrees of freedom in space represent the minimum number for which a robotized arm can support with efficacy the movement of an armament. Preferably, an optimal number of degrees of freedom is six, more preferably seven degrees of freedom.

Figure 2:
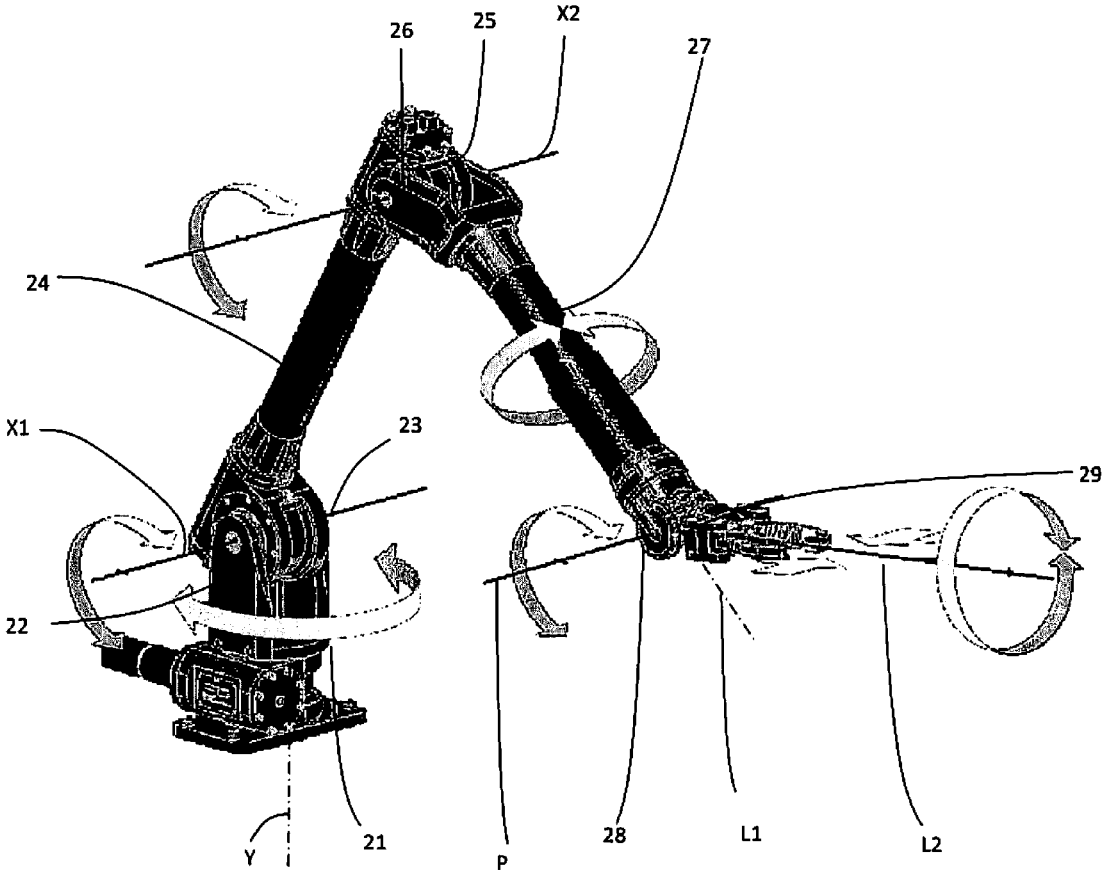
FIG. 2 is a perspective view of the robotized arm according to the present invention.

In FIG. 2 is shown an example of embodiment of said robotized arm comprising a resting plate 21, rotating with respect to said supporting plate 12 about a first vertical axis Y. Upon said resting plate 21 there is a first fork 22, preferably realized in a unique body with the plate, wherein a first sleeve 23 is pivoted, rotating with respect to a first horizontal axis X1. Said sleeve is integral with respect to one end of a first rod 24, which, at the opposite end, has an annular support 25 on which a second fork 26 is pivoted, rotating with respect to the annular support about a second horizontal axis X2.

The second fork 26 is associated to the first end of a torsion bar 27, which can turn about its longitudinal axis L1 with respect to the fork. At the end of this bar opposite to the one constrained to the second fork a third fork 28 is present, integral with respect to said bar and to which an elongated support 29 for an armament is constrained in an articulated way, which can turn about an axis P perpendicular to longitudinal axis L1 of the bar.

Furthermore, this elongated support 29 can turn about its longitudinal axis L2.

Armament 3 is opportunely constrained to a bracket 291 of said support. The robotized arm enables the armament to move having a plurality of degrees of freedom, in the specific example the degrees of freedom are six in all, because the armament can move respectively about axis Y, X1, X2, L1, P and L2, as shown in FIG. 2.

Clearly, for each degree of freedom, the robotized arm comprises at least a motor duly controlled from inside the vehicle. Furthermore, from inside the vehicle the armament is also completely controlled.

The robotized arm in this way supports the movements of the armament, which can lay also objects not directly visible from the passenger compartment. For example, extending the arm and putting rod 24 and bar 27 in a longitudinal position and positioning support 29 such that it is orthogonal with respect to bar 27 itself, it can be created a substantially 90° angulated structure able to lay the armament behind an angle of a building keeping the vehicle hidden. In another similar configuration, the armament can be laid further than a wall keeping the vehicle hidden under the wall itself, etc.

In these cases, clearly, on the arm can be advantageously provided laying and viewing means or systems, such as for example a day/night stabilized periscopic viewer, or a stabilized viewer with thermal view and laser telemeter which permit to the personnel inside the vehicle to have the view of the zone laid by the armament.

The invention claimed is:

1. Robotized arm mounted on a supporting plate configured for installation on an upper surface of a vehicle, said vehicle comprising a conventional passenger compartment for housing operators, said robotized arm comprising:

an armament which is supported at the free end of said arm, said robotized arm enabling said armament to have at least six degrees of freedom in space;

a resting plate which rotates said arm with respect to said supporting plate above said vehicle about a first vertical axis;

a first fork on said resting plate;

a first sleeve pivoted on said fork and rotatable with respect to a first horizontal axis;

an elongated first rod having a first end which is integral with said first sleeve;

an annular support on an opposite end of said elongated first rod;

a second fork extending from a torsion bar, the second fork being pivoted on said annular support to rotate about a second horizontal axis with respect to said annular support, said second horizontal axis being maintained parallel to said first horizontal axis;

the torsion bar having a first longitudinal axis and a first end integrally mounted to said second fork; said torsion bar being rotatable about the first longitudinal axis with respect to said second fork and the first longitudinal axis of the torsion bar being maintained perpendicular to the first horizontal axis and the second horizontal axis;

a third fork at an end of said torsion bar which is opposite to the first end of the torsion bar; said third fork being integral with said torsion bar;

an elongated support carrying the armament and constrained in an articulated way to the third fork;

said elongated support having a second longitudinal axis and being able to turn about an axis perpendicular to the longitudinal axis of the torsion bar and being able to turn about the second longitudinal axis;

wherein the arm extends above the vehicle with an unobstructed range of motion about the first vertical axis above the upper surface of said vehicle.

2. The arm according to claim 1, wherein the vehicle is a wheeled or tracked vehicle.

3. The arm according to claim 1, having laying and viewing systems, which enable the operators within the vehicle to view the area laid at by the armament.

4. The arm according to claim 1, wherein said viewing means comprise a stabilized day/night periscopic viewer, or a stabilized viewer with thermal view and laser telemeter.

5. The arm according to claim 1, further comprising a motor for each degree of freedom controlled remotely from within the vehicle.

6. The arm according to claim 1, wherein the armament is constrained to a bracket of said elongated support.

7. The arm according to claim 1, wherein the third fork is integral with the torsion bar.

8. The arm according to claim 1, wherein the arm is configured to extend the elongated first rod and the torsion bar in a longitudinal position and positioning the elongated support orthogonally with respect to the torsion bar, with the arm configured as a substantially 90° angulated structure with the armament extending laterally from the vehicle.

9. The arm according to claim 1, wherein the first fork defines a first plane perpendicular to the first horizontal axis and wherein the elongated first rod and the torsion bar move within the first plane.

10. A robotized arm and vehicle, the robotized arm being mounted on a supporting plate installed on an upper surface of the vehicle, said vehicle comprising a conventional passenger compartment for housing operators, said robotized arm comprising:

an armament which is supported at the free end of said arm, said robotized arm enabling said armament to have at least six degrees of freedom in space;

a resting plate which rotates said arm with respect to said supporting plate above said vehicle about a first vertical axis;

a first fork on said resting plate;

a first sleeve pivoted on said fork and rotatable with respect to a first horizontal axis;

an elongated first rod having a first end which is integral with said first sleeve;

an annular support on an opposite end of said elongated first rod;

a second fork extending from a torsion bar, the second fork being pivoted on said annular support to rotate about a second horizontal axis with respect to said annular support, said second horizontal axis being maintained parallel to said first horizontal axis;

the torsion bar having a first longitudinal axis and a first end integrally mounted to said second fork; said torsion bar being rotatable about the first longitudinal axis with respect to said second fork and the first longitudinal axis of the torsion bar being maintained perpendicular to the first horizontal axis and the second horizontal axis;

a third fork at an end of said torsion bar which is opposite to the first end of the torsion bar; said third fork being integral with said torsion bar;

an elongated support carrying the armament and constrained in an articulated way to the third fork;

said elongated support having a second longitudinal axis and being able to turn about an axis perpendicular to the longitudinal axis of the torsion bar and being able to turn about the second longitudinal axis;

wherein the arm extends above the vehicle with an unobstructed range of motion about the first vertical axis above said upper surface of said vehicle.

* * * * *